US009976303B2

(12) United States Patent
Gloftis et al.

(10) Patent No.: US 9,976,303 B2
(45) Date of Patent: May 22, 2018

(54) SUSPENDED CEILING CLIP

(71) Applicant: Locking Key Pty Ltd as Trustee for Locking Key Unit Trust, Miami (AU)

(72) Inventors: Jason Michael Gloftis, Miami (AU); Grant Peter O'Brien, Miami (AU)

(73) Assignee: Locking Key PTY LTD, Miami, Queensland (AU), as Trustee for Locking Key Unit Trust ( * ) Notice: Subject to any disclaimer, the term of this patent is extended or adjusted under 35 U.S.C. 154(b) by 0 days. days.

(21) Appl. No.: 15/305,814

(22) PCT Filed: Apr. 20, 2015

(86) PCT No.: PCT/AU2015/050185
§ 371 (c)(1),
(2) Date: Oct. 21, 2016

(87) PCT Pub. No.: WO2015/161342
PCT Pub. Date: Oct. 29, 2015

(65) Prior Publication Data

US 2017/0044767 A1 Feb. 16, 2017

(30) Foreign Application Priority Data

Apr. 23, 2014 (AU) ..... 2014901466

(51) Int. Cl.
*E04B 2/00* (2006.01)
*E04B 5/00* (2006.01)
(Continued)

(52) U.S. Cl.
CPC ..... *E04B 9/245* (2013.01); *E04B 9/18* (2013.01); *E04B 9/183* (2013.01); *E04B 9/225* (2013.01)

(58) Field of Classification Search
CPC . E04B 9/245; E04B 9/18; E04B 9/183; E04B 9/225; E04B 9/16; E04B 9/10;
(Continued)

(56) References Cited

U.S. PATENT DOCUMENTS 2,909,355 A * 10/1959 Nelson ..... E04B 9/18 110/111
4,614,072 A 9/1986 Price
(Continued)

FOREIGN PATENT DOCUMENTS

AU 140982 S 6/2000

OTHER PUBLICATIONS

Rondo Key-Lock brochure found on Wayback Machine dated Jul. 7, 2013 at: https://web.archive.org/web/20130707071720/https://www.rondo.com.au/products/ceilings/.*
(Continued)

*Primary Examiner* — Brian D Mattei
(74) *Attorney, Agent, or Firm* — Servilla Whitney

(57) ABSTRACT

The present invention relates in general to a suspended ceiling clip and method of using the clip to support a grid-work of channels in a key lock concealed grid suspended ceiling system. The suspended ceiling clip is used for mounting a furring channel to a top cross rail. The clip comprising a longitudinally extending base; a pair of flanges extending downwardly from the base and between which the base is located; a pair of hooks on each flange, each pair of hooks adapted to releasably connect to the furring channel; at least one projection in each flange, each projection engaging with a surface on the top cross rail to secure the clip within a longitudinal slot of the top cross rail; and wherein the air of flanges extend a predetermined distance from the base so as to space apart the top cross rail and the furring channel to provide a void therebetween.

2 Claims, 7 Drawing Sheets

(51) Int. Cl.

| | |
|---|---|
| ***E04B 9/00*** | (2006.01) |
| ***E04B 9/24*** | (2006.01) |
| ***E04B 9/18*** | (2006.01) |
| ***E04B 9/22*** | (2006.01) |

(58) Field of Classification Search
CPC . E04B 9/30; E04B 9/006; E04B 9/067; E04B 9/34; E04B 9/26
See application file for complete search history.

(56) References Cited

U.S. PATENT DOCUMENTS

| | | | | |
|---|---|---|---|---|
| 4,678,487 | A * | 7/1987 | Cadwell, Jr. | E04B 9/02 52/506.06 |
| 5,667,181 | A * | 9/1997 | van Leeuwen | E04B 9/18 248/343 |
| 9,187,897 | B1 * | 11/2015 | Bergman | E04B 9/003 |
| 2015/0211231 | A1 * | 7/2015 | Bergman | E04B 9/0435 52/489.1 |
| 2016/0251855 | A1 * | 9/2016 | Heesbeen | E04B 9/16 52/506.05 |

OTHER PUBLICATIONS

International Preliminary Report on Patentability in PCT/AU2015/050185, dated Feb. 24, 2016, 3 pages.

International Search Report in PCT/AU2015/050185, dated Jun. 2, 20215, 6 pages.

Written Opinion in PCT/AU2015/050185, dated Jun. 2, 2015, 8 pages.

"Long Furring Channel Clip from Rondo Building Services [retrieved from internet on Mar. 25, 2015].", <URL: https://web.archive.org/web/20120408181137/http://www.spec-net.com.au/press/0710/ron_140710.htm>, published on Apr. 8, 2012 as per Wayback Machine., 2 pgs.

"Rondo Key-Lock Concealed Suspended Ceiling Systems—Installation Guide [retrieved from internet on Mar. 16, 2015].", <URL: https://web.archive.org/web/20130608010404/http://www.rondo.com.au/products/ceilings/keylock>, published on Jun. 8, 2013 as per Wayback Machine., 2 pgs.

* cited by examiner

SUSPENDED CEILING CLIP

CROSS REFERENCE TO RELATED APPLICATIONS

This is a National Phase entry of International Application No. PCT/AU2015/050185, filed Apr. 20, 2015, which claims priority to Australian Application No. 2014901466, filed Apr. 23, 2014, the disclosures of which are incorporated herein by reference in their entireties.

FIELD OF THE INVENTION

This invention relates generally to a ceiling suspension unit of the kind adapted to support a grid-work of channels suspended from an overhead structure. In particular, the present invention relates to a suspended ceiling clip and method of using the clip to support the grid-work of channels in a key lock concealed grid suspended ceiling system.

BACKGROUND OF THE INVENTION

It should be noted that reference to the prior art herein is not to be taken as an acknowledgement that such prior art constitutes common general knowledge in the art.

Suspended ceilings, which may also be referred to as drop ceilings or false ceilings, are well known and are available in a variety of design options. Suspended ceilings typically include a suspended grid of support members hanging from wires or rods attached to the plenum, and panels or planks secured to the grid. The popularity of these ceilings is due, at least in part, to the visual and acoustic benefits coupled with the simplicity and ease of installation of the system.

The most common form of suspended ceilings includes light weight panels, often square or rectangular in shape, that "drop" into a supporting T-grid without additional fastening mechanisms. These types of drop ceilings provide easy access to the plenum space above the ceiling for access to air conditioning equipment, wiring, plumbing, and the like. However, many customers, both residential and commercial, view these types of ceilings as unattractive.

Accordingly, there has been an increasing demand for more aesthetically pleasing suspended ceilings that include a flush building board ceiling finish. These systems typically remove the supporting T-grid and direct-fix plasterboard to a grid-work of channels and overhead structure to provide a more pleasing flush finish. These systems use clips and hangers in order to suspend a grid of furring channel and top cross rails below a supporting structure which can then be sheeted with an appropriate board lining. This allows the designer to bring the ceiling level down to the required height and provides space in the ceiling cavity for services such as air-conditioning.

These direct-fix systems may be more aesthetically pleasing, but present installation difficulties not associated with the more common drop-in panels. These types of system typically require special supporting grids in order to suspend the plasterboard. The specialised supporting grids contain a grid work of channels which may render the ceiling system more expensive and/or more complicated. With plasterboard being directly fixed to a furring channel the distance between the finished plasterboard surface and the top cross rail is determined by the locking key which retains the furring channel to the top cross rail. This minimum distance needs to be considered when mounting items in or on the ceiling system. For example, the small clearance between the top cross rail and the furring channel can be problematic when mounting recessed lighting or the like components in the ceiling.

Given the number of furring channels and top cross rails required to direct fix the plasterboard, it can be somewhat limiting where items like lighting, speakers and air conditioning ducts and vents can be placed. These items are typically flush mounted onto the outside surface of the plasterboard and the majority of the size of these items is located within the ceiling cavity formed between the plasterboard and the grid work of channels forming the suspended ceiling frame. Therefore there needs to be sufficient clearance within the cavity for these items. Likewise these items are normally mounted using some form of clip retainer which needs to be located on the opposite side of the plasterboard to where the item is located, so there must also be sufficient clearance for these attachment devices within the grid work of channels of the suspended ceiling.

A number of difficulties also exist in that they are time-consuming to install and accuracy of spacing may be poorly maintained over large expanses of ceiling. Support system designs that provide ready access into the plenum above usually do so at the expense of a cluttered appearance with too much of the support system being visible from below. Another problem is that supports that pass alongside recessed fluorescent lighting fixtures often intrude into the area that should be kept clear in order to realise minimum interference with the flow of room supply air furnished by air supply boots attached to the fixtures.

Clearly it would be advantageous if a locking key for a suspended ceiling could be devised that helped to at least ameliorate some of the shortcomings described above. In particular, it would be beneficial if a locking key which has the ability to provide a clearance between the top cross channel and the furring channel was devised or to at least provide a useful alternative.

SUMMARY OF THE INVENTION

In accordance with a first aspect, the present invention provides a suspended ceiling clip for mounting a furring channel to a top cross rail, the clip comprising: a longitudinally extending base; a pair of flanges extending downwardly from the base and between which the base is located; a pair of hooks on each flange, each pair of hooks adapted to releasably connect to the furring channel; at least one projection in each flange, each projection engaging with a surface on the top cross rail to secure the clip within a longitudinal slot of the top cross rail; and wherein the pair of flanges extend a pre-determined distance from the base so as to space apart the top cross rail and the furring channel to provide a void therebetween.

Preferably, the pair of hooks on each flange may be adapted to releasably connect to an out-turned opposing longitudinal jaw extending from the furring channel. The pair of flanges may be generally parallel co-extensive flanges extending downwardly from the base.

Preferably, the pre-determined distance from the base of the clip to the hooks may be in the range of 50 to 500 mm.

Alternatively, the pair of flanges may extend downwardly and diverge away from a channel section formed by the base and two side sections extending from either side of the base. The pair of flanges may extend downwardly and diverge away from each other so as to form equal angles on either side of a perpendicular axis passing through the centre of the base. Preferably, the equal angles may bee approximately 30 degrees either side of the perpendicular axis passing through the centre of the base. Preferably, at least one plate may be inserted at a position adjacent to the hooks to space apart the hooks and provide the clip with strengthening at the hook end of the clip. The at least one plate may be fixedly connected at each corner of the clip such that each hook is supported and held rigidly in position. Preferably, the pre-determined distance from the base of the clip to the hooks may be in the range of 50 to 500 mm.

Preferably, the at least one projection may be pressed from the flange at a location adjacent the base of the clip. Alternatively, two projections may be pressed in each flange at a location at or near the base of the clip. The pressed projection may form a ramp surface extending transversely outwardly from each respective flange.

Preferably, the top cross rail may comprise a base extending longitudinally with a pair of generally parallel co-extensive flanges extending downwardly from the base and forming the longitudinal slot bordered by in-turned opposing longitudinal jaws on each flange. By resiliently deforming the flanges allows the projections and ramp sections to snap fit within the in-turned opposing longitudinal jaws extending from the top cross rail and to inhibit the removal of the clip from the top cross rail.

Preferably, the clip may be designed to be free to slide along the cross rail when the flanges are resiliently deformed, therefore making the clip adjustable within the top cross rail.

Preferably, the clip may further comprise a hanger assembly with jaws for accommodating and securing a top section of the top cross rail, the hanger assembly having an adjustable anchorage for suspending at a selected level the top cross rail from a structural part of a building located above a suspended ceiling. The adjustable anchorage may comprise a pair of extendible rods frictionally joined together at adjacent ends by an apertured bowed leaf spring.

Preferably, the clips may be manufactured from a resiliently deformable material. The resiliently deformable material may be any one of a sheet metal made from aluminium or steel or a high density plastic material.

Preferably, a flush mounted builders ceiling board may be fixed to the bottom of the furring channel. The void formed between the top cross rail and the furring channel may be sized to allow the flush mounting or mounting of components within the flush mounted builders ceiling board and the void.

In accordance with a further aspect, the present invention provides a clip for use in a suspended ceiling comprising a grid structure of a plurality of top cross rails suspended from hangar assemblies, a plurality of parallel mounted furring channels to which a flush mounted builders ceiling board is fixed, the parallel mounted furring channels extending beneath and crossing the top cross rails, the clip comprising: a longitudinally extending base; a pair of flanges extending downwardly from the base and between which the base is located; a pair of hooks on each flange, each pair of hooks adapted to releasably connect to the parallel mounted furring channels; at least one projection in each flange, each projection engaging with a surface on the top cross rail; and wherein the pair of flanges are resiliently deformed to allow insertion of the clip within the top cross rail and each flange extends a pre-determined distance from the base so as to space apart the top cross rail and the parallel mounted furring channels to provide a void therebetween.

In accordance with a still further aspect, the present invention provides a ceiling construction for suspension within a room of a building or an external ceiling, comprising when assembled within said room: a plurality of parallel spaced top cross rails; a plurality of adjustable length hanger assemblies anchored to structural parts of the building and connected with each top cross rail suspending same at a selected height in a common plane with other ones of said top cross rails; a plurality of parallel mounted furring channels to which a flush mounted builders ceiling board is fixed, the parallel mounted furring channels extending beneath and crossing the top cross rails; and a clip with features in accordance with any one of previous aspects for joining the top cross rails to the parallel mounted furring channels such that the parallel mounted furring channels are spaced apart a pre-determined distance from the top cross rails to provide a void therebetween.

In accordance with a still further aspect, the present invention provides a method of constructing a suspended ceiling using the clip with the features of any of the previous aspects, the method comprising the steps of: fixing at least one hangar from a structural part of a building; attaching at least one top cross rail to the at least one hanger; inserting at least one clip inside a longitudinal slot in the top cross rail; positioning at least one parallel mounted furring channel below the top cross rails and attached to hooks on the clip; and wherein the joining of the top cross rails to the parallel mounted furring channels by the clips are such that the parallel mounted furring channels are spaced apart a pre-determined distance from the top cross rails to provide a void therebetween.

In accordance with a still further aspect, the present invention provides a suspended ceiling within a room of a building or an external ceiling, comprising when assembled within said room: a plurality of parallel spaced top cross rails; a plurality of adjustable length hanger assemblies anchored to structural parts of the building and connected with each top cross rail suspending same at a selected height in a common plane with other ones of said top cross rails; a first clip as described in any one of the previous aspects for joining the top cross rails to a first group of parallel mounted furring channels such that the first group of parallel mounted furring channels are spaced apart a first pre-determined distance from the top cross rails to provide a void therebetween; a second clip as described in any one of the previous aspects for joining the top cross rails to a second group of parallel mounted furring channels such that the second group of parallel mounted furring channels are spaced apart a second pre-determined distance from the top cross rails to provide a void therebetween; a first flush mounted builders ceiling board fixed to the first group of furring channels; a second flush mounted builders ceiling board fixed to the second group of furring channels; and wherein the second pre-determined distance is greater than the first pre-determined distance to therefore forming two different heights in the ceiling.

Preferably, the suspended ceiling may further comprises a vertically mounted third flush mounted builders ceiling board to close the gap between the first and second ceiling boards. The first and second clips may be used to design a bulkhead in the suspended ceiling.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

DETAILED DESCRIPTION OF THE PREFERRED EMBODIMENTS

The following description, given by way of example only, is described in order to provide a more precise understanding of the subject matter of a preferred embodiment or embodiments.

Figure 1:
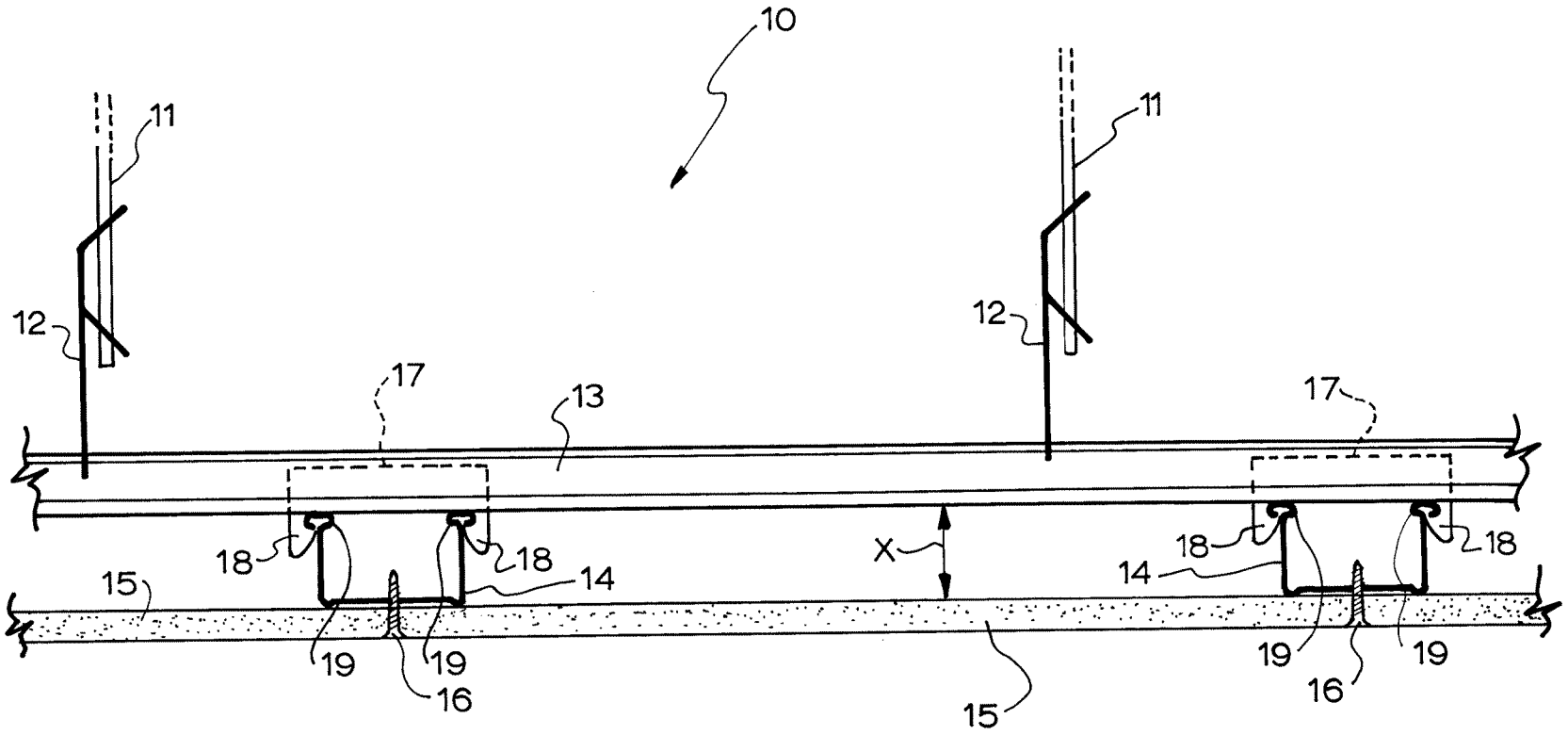
FIG.1 (Prior Art)
FIG. 1 illustrates a fragmentary perspective view of part of a concealed suspended ceiling constructed.

FIG. 1 illustrates a typical concealed suspended ceiling 10 showing flush mounted builders ceiling board such as plasterboard 15 secured in place. In FIG. 1 the complete structure 10 is suspended from fixing points (not shown) on a roof or upon floor beams of a room of higher level by means of suspension hangers 12. The suspension hangers 12 include a "U" shaped spring clip with diverging free arms. The spring clip is rivetted at its base to a vertical plate forming the body of the hanger 12. Holes are provided near the ends of the arms and a ceiling suspension rod 11 is passed through said holes so that the hanger 12 is locked upon said rod 11 by the impinging action of the spring arms on said rod 11. If the arms are displaced towards one another the rod 11 will be released so that the hanger 12 can be slid up or down said rod 11.

The lower end of the hangar body plate is slotted to form inwardly directed hooks to attach the hangar 12 to the top cross rail 13. The cross rail or bar 13 of any desired form providing it has a longitudinal base of suitable enlarged dimension, which is held by the hanger 12 between its confronting end hooks. In a complete ceiling suspension system 10 several or many parallel top cross rails or bars 13 will be suspended by spaced hanger assemblies 12 to form the foundation from which the plasterboard panels 15 will be supported.

Figure 5:
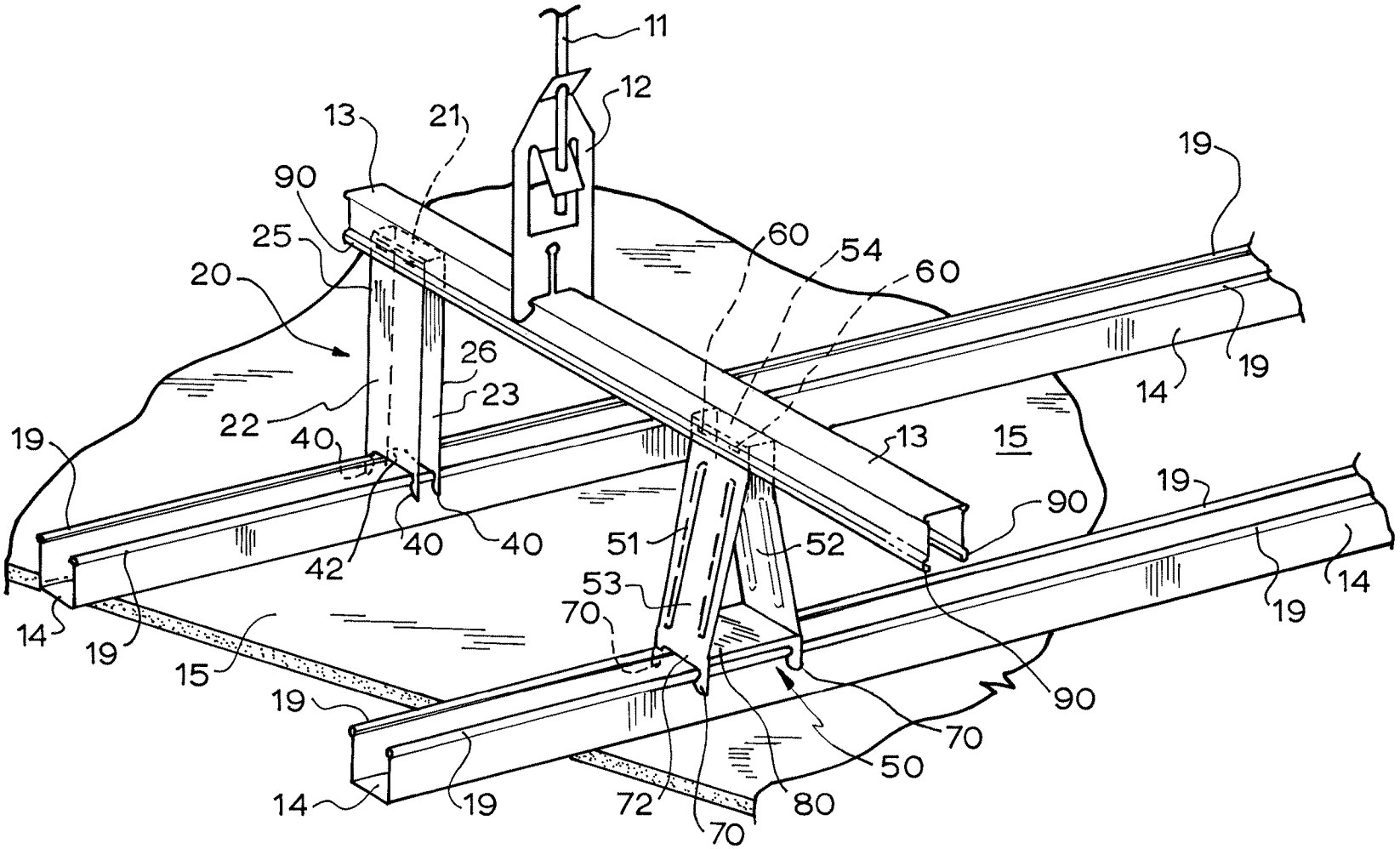
FIG. 5 illustrates a fragmentary perspective view of part of a suspended ceiling constructed showing the locking clips of FIGS. 2 and 3 in use.

It is the usual practice to provide the top cross rails 13 with a longitudinal slot bordered by in-turned longitudinal jaws 90 (See FIG. 5). A suitable form of furring channel 14 for the supporting of the plasterboard panels 15 is supported at right angles to the top cross rails 13 by individual clip devices 17. The plasterboard 15 is attached to the furring channel 14 by suitable fasteners 16. Each clip device 17 is formed as a plate of sheet metal folded approximately U-shaped with a flat base and approximately parallel arms. At an intermediate position the two arms may have outwardly directed tabs 30, 60. The outer edge of each arm carries two longitudinally extending hook elements 18 which are located at either end of the arm at spaced positions on the clip device 17 and have their hooks 18 confronting each other. The hook elements 18 connect with the outturned opposing longitudinal jaws 19 extending from the furring channels 14. During assembly the clip device 17 is forced upwardly into the slot of the cross bar 13 with its base portion leading, so that the clip 17 will be held by the tabs 30, 60 in its arms between the longitudinal jaws 90 of the top cross rail 13.

From this assembly a very rigid connection between the respective components results and the distance X (FIG. 1) represents the distance that the backside of the plasterboard 15 is located from the bottom of the top cross rail 13. The distance X also represents the height of the furring channel 14.

Figure 3:
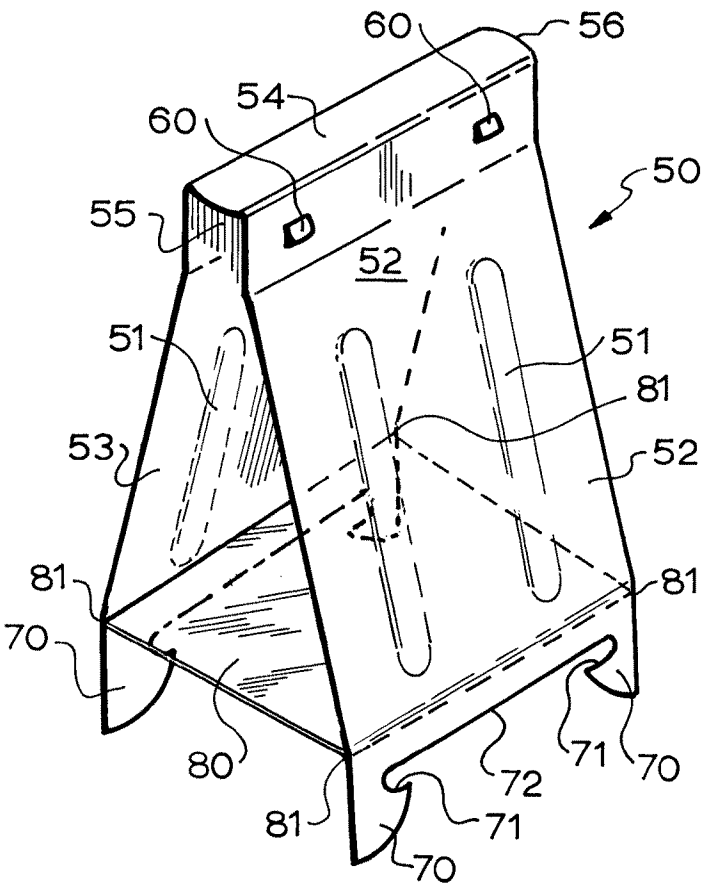
FIG. 3 shows a perspective view of a locking clip used for securing the furring channel to the top cross channel in accordance with a second embodiment of the present invention.
Figure 2:
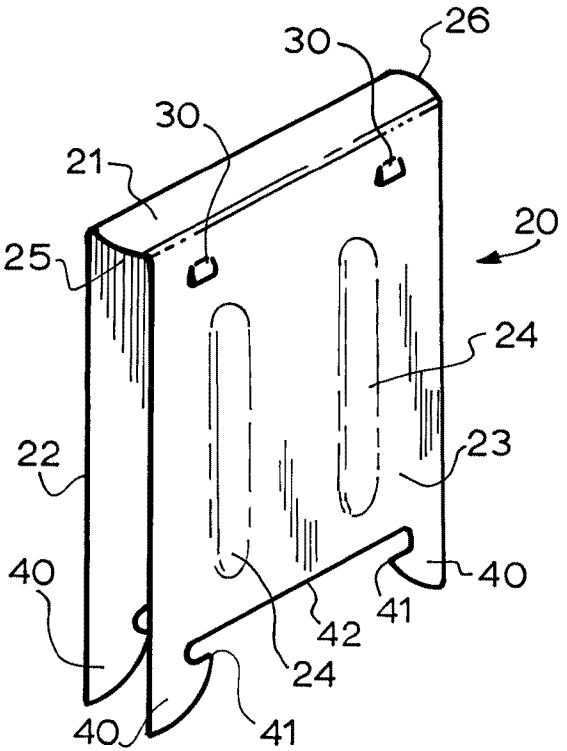
FIG. 2 shows a perspective view of a locking clip used for securing the furring channel to the top cross channel in accordance with a first embodiment of the present invention.

FIGS. 2 and 3 represent two embodiments of the clip 20, 50 in accordance with the present invention. FIG. 2 shows a first embodiment in which a clip 20 is designed to snap engage within the longitudinal slot of the top cross rail 13. Typically the top cross rail 13 is attached to the under surfaces of a concrete slab or timber structure directly or suspended by rods 12 or similar hanger members 12 from the concrete slab or floor structure above. The top cross rail 13 has a longitudinal top and a pair of generally parallel and co-extensive flanges. The flanges project generally downwardly from the top and provide a longitudinally extending cavity into which the clip 20 projects. Each of the flanges terminates along its lower edge with an upwardly extending in-turned longitudinal portion 90. The longitudinal portions 90 are adapted to engage with the tabs 30 of the clip 20.

The clip 20 is of a channel configuration so as to have a longitudinal base 21 extending from a first end 25 to a second end 26 and a pair of longitudinally extending flanges 22, 23. The base 21 is located between the flanges 22, 23 with the flanges 22, 23 extending downwardly from the base 21. The base 21 has an inner (lower) surface and an outer (upper) surface. Each of the flanges 22, 23 is provided with one or more projections 30 or outwardly directed tabs 30. In this embodiment the projections 30 are pressed from the flanges 22, 23 to form tabs or ramp surfaces 30. The projections 30 are located on the outside of the flanges 22, 23 adjacent to the base 21 of the clip 20. The clip 20 also has at least one and preferably two strengthening elements 24 in each flange 22, 23. The strengthening elements 24 are formed by stamping or pressing the sheet metal. For example, stamping (also known as pressing) is the process of placing flat sheet metal in either blank or coil form into a stamping press where a tool and die surface forms the metal into a net shape. In this particular case the stamping or pressing is used to form the strengthening elements 24 in each side of the clip 20. This is particularly important when the size of the clips extend to around 200 to 500 mm in length. The strength added by the elements 24 further provides flexural stability to the clips 20.

Further strengthening may be added to the clip 20 in the form of plates (not shown) fixedly retained in between the downwardly extending flanges 22, 23. Due to the variation in the length of the clips 20 (the length of the flanges 22, 23) more than one plate may be required to further reinforce and strengthen the clip 20. Typically a plate may be welded at the lower end of the flanges 22, 23 towards the hook end of the clip 20.

Each clip device 20 may be formed as a plate of sheet metal folded to approximately form a U-shaped channel configuration with a flat base 21 and approximately parallel arms 22, 23 extending from either side of the base 21. The outer lower edge of each arm 22, 23 carry two longitudinally extending hook elements 40. Each hook element 40 is located at opposing ends of each arm 22, 23 at spaced apart positions on the clip device 20, with each hook 40 being inwardly orientated towards each other. The hook elements 40 connect with the out-turned opposing longitudinal jaws 19 extending from the furring channels 14. The bottom section of each arm 22, 23 including the hooks 40 which project to an end point 41 and a cut-out section 42 are designed to allow the furring channel 14 to be inserted into the cut-out section 42. The opposing longitudinal jaws 19 of the furring channel 14 are forced upwardly into and retained within the hooks 40 of the clip 20. Thus the shape of the cut-out section substantially conforms to the shape of the furring channel 14.

The length measured from the base 21 to the bottom of the hooks 40 of each arm or flange 22, 23 is sized so as to provide the clearance between the cross rail 13 and the bottom of the furring channel 14 to which surface the plasterboard 15 is fixed. Therefore providing a void in between the back side of the plasterboard 15 and the bottom of the top cross rail 13. The void allows the flush mounting of such items as speakers, lights and air conditioning components into and through the plasterboard 15. This will be further described in FIGS. 6 and 7 below. However it should also be understood that the use of the clip 20, 50 is not limited to only the flush mounting of components in ceilings and other uses within the field of suspended ceiling are included within the present scope of the invention. Typically the arms 22, 23 range in size from 50 to 500 mm which provides the present invention with a void of approximately the same dimension.

In use the clip 20 is inserted in an upward direction so that the ramp surfaces 30 of the clip 20 engage with and push past the longitudinally extending jaws 90 of the top cross rail 13. Due to resilient nature of the flanges 22, 23 and the sides of the top cross rail 13 the clip 20 is pushed upward to locate within the longitudinal slot within the top cross rail 13. When the projections 30 of the clip 20 move past the longitudinally extending jaws 90, the clip 20 snap engages into the slot within the top cross rail 13 between the jaws 90. The jaws 90 engage with the bottom of the projections 30 and substantially retain the projections 30 within the jaws 90 as best seen in FIG. 5. The projections 30 inhibit removal of the clip 20 from within the top cross rail 13 due to not being able to move in the direction opposite to the initial upward direction. The clips 20 can be removed from the top cross rail 13 by pushing the clip 20 in an upward direction and the longitudinal sides of the top cross rail 13 being deformed to release the clip 20. Likewise the hooks 40 engage with the out-turned opposing longitudinal jaws 19 extending from the furring channels 14 to secure the furring channel 14 in place. This then allows the plasterboard 15 to be secured by fasteners 16 to the bottom section of the furring channel 14.

FIG. 3 shows a further embodiment of the present invention in which a clip 50 is designed to snap engage within the top cross rail 13. Like the clip 20 the clip 50 is of a channel configuration so as to have a longitudinal base 54 extending from a first end 55 to a second end 56 and a pair of longitudinally extending flanges 52, 53 extending downwardly from the base 54. In this embodiment the flanges 52, 53 have an initial intermediate section adjacent to the base 54 which extends at approximate right angles to and from the base 54 and houses the one or more projections 60 or outwardly directed tabs 60. The intermediate area forms an open area 57 (better shown in FIG. 4) formed within the area of the intermediate area and the base 54. The base 54 is located between the flanges 52, 53 with the flanges 52, 53 extending downwardly and outwardly from the intermediate section. The flanges 52, 53 forming an angle of approximately 30 degrees with a perpendicular axis passing through the centre of the base 54 and aligned with either end 55, 56.

In this embodiment the projections 60 are pressed from the flanges 52, 53 in the intermediate section to form ramp surfaces 60. The clip 50 also has at least one and preferably two strengthening elements 51 in each flange 52, 53. To provide further strengthening at the hook end of the clip 50 a plate 80 is fixedly retained at bottom corners 81 of the flanges 52, 53 of the clip 50. As described above in relation to clip 20 these elements 51 can be stamped or pressed in the flanges 52, 53. Typically the plate 80 is welded in place along the bottom edge of each flange 53, 53. Further plates 80 may be inserted at different heights in between the flanges 52, 53 and the location of each plate 80 is dependent upon the length of the flanges 52, 53 and subsequently the size of the void required between the back side of the plasterboard 15 and the bottom of the top cross rail 13.

Each clip device 50 may be formed as a plate of sheet metal folded approximately U-shaped forming a channel configuration with a flat base 54, an intermediate section and a pair of flanges or arms 52, 53 which extend downwardly and diverge away at an angle of approximately 30 degrees from the perpendicular axis passing through the base 54 of the clip 50.

Figure 6:
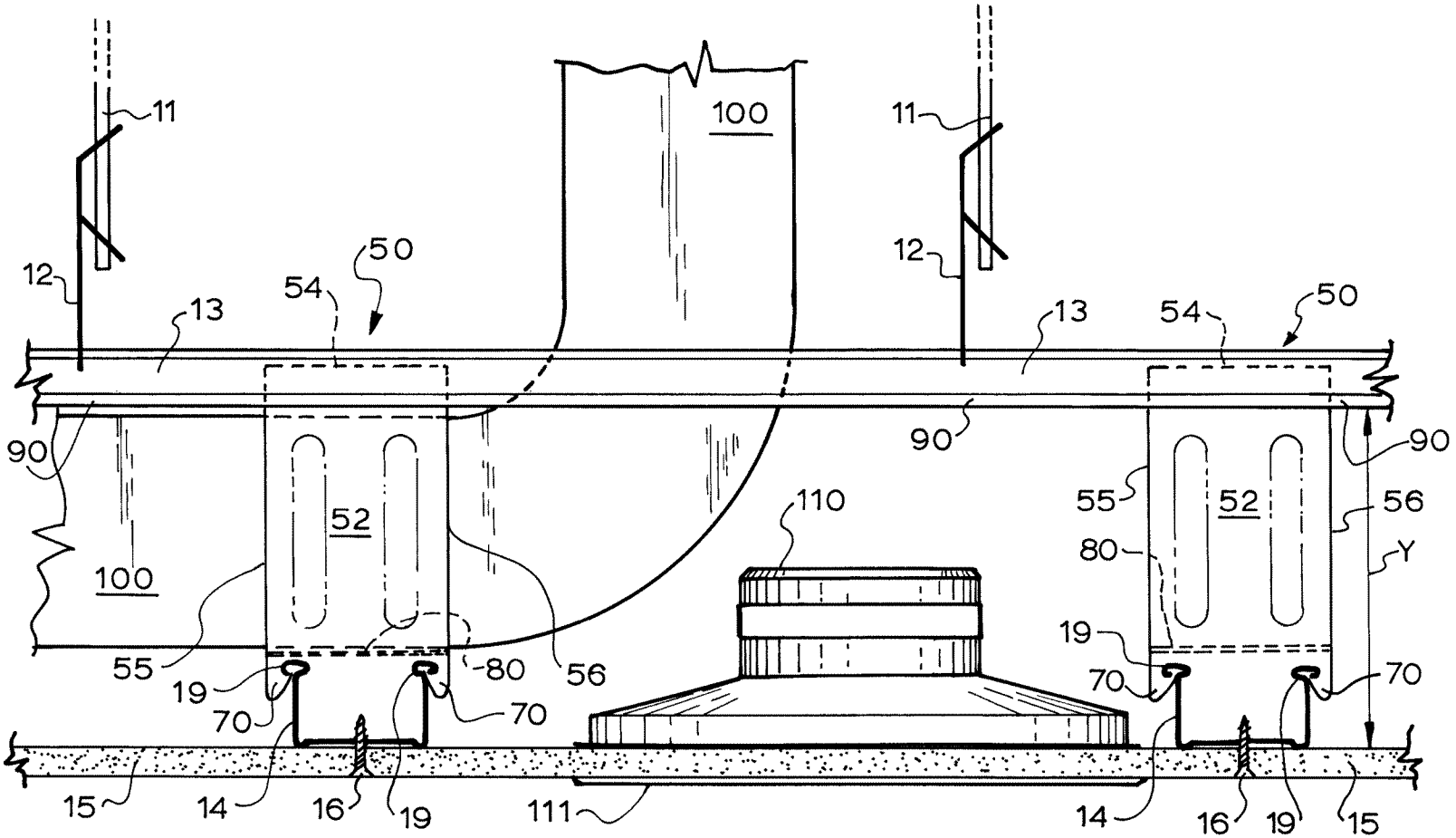
FIG. 6 illustrates a side view of a suspended ceiling showing air conditioning ducting and a speaker mounted in the ceiling using the locking clip of FIG. 3.
Figure 7:
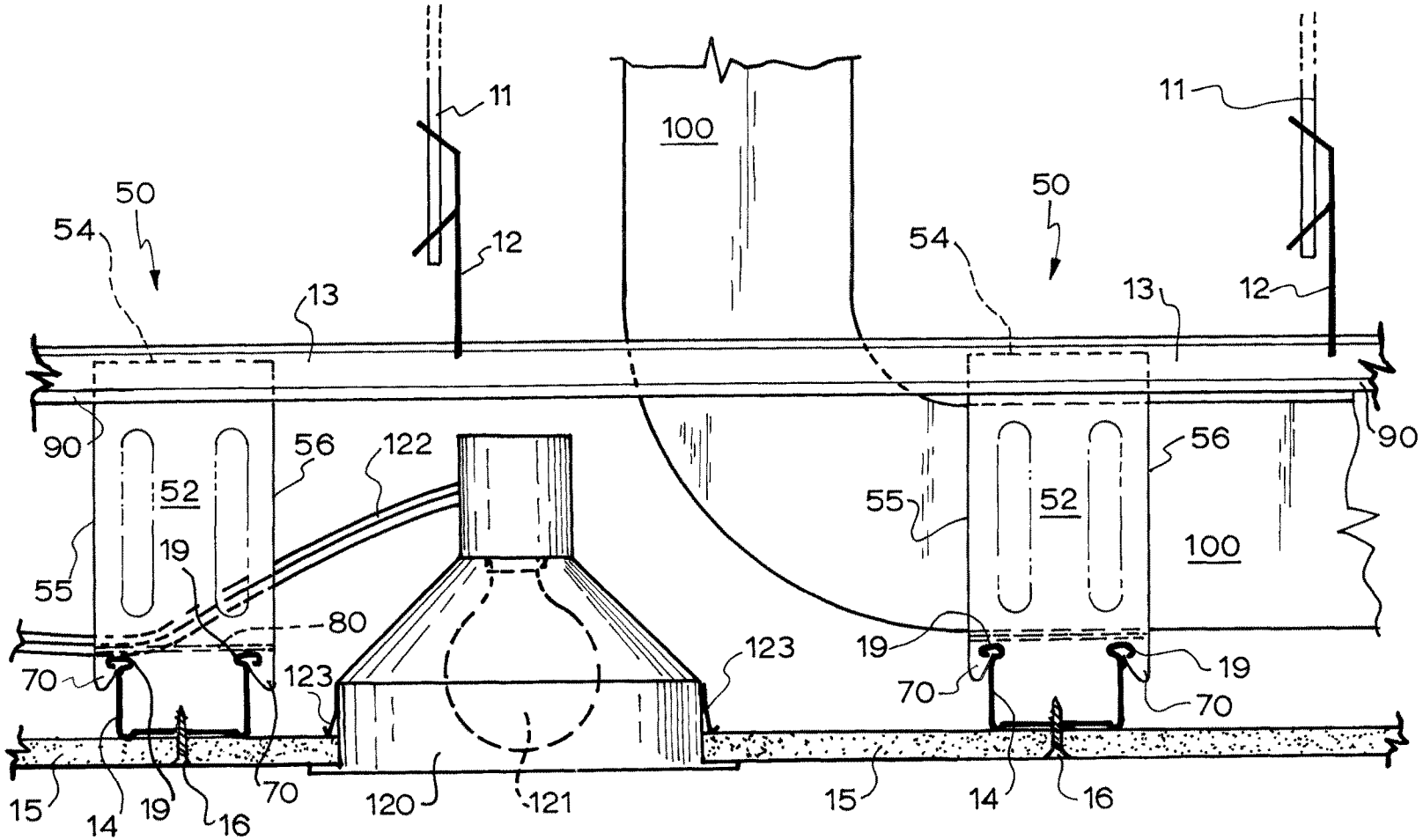
FIG. 7 illustrates a side view of a suspended ceiling showing air conditioning ducting and a light mounted in the ceiling using the locking clip of FIG. 3.

The outer lower edge of each arm 52, 53 carries two longitudinally extending hook elements 70 which are located at either end of the arms 52, 53 at spaced positions on the clip device 50 and have their hooks 70 confronting each other. The hook elements 70 connect with the out-turned opposing longitudinal jaws 19 extending from the furring channels 14. The bottom section including the hooks 70 which project to an end point 71 and the cut-out section 72 which have been designed to allow the furring channel 14 to be inserted into the cut-out section 72. The opposing longitudinal jaws 19 of the furring channel 14 are forced upwardly into and retained within the hooks 70 of the clip 50. Thus the shape of the cut-out section 72 substantially conforms to the shape of the top section of the furring channel 14. Each arm or flange 52, 53 is sized so as to provide the clearance between the top cross rail 13 and the bottom of the furring channel 14 to which surface the plasterboard 15 is fixed. Therefore providing a void in between the back side of the plasterboard 15 and the bottom of the top cross rail 13 allowing such items as speakers, lights and air-conditioning components to be easily installed as is shown in FIGS. 6 and 7 below. Typically the arms 52, 53 range in size from 50 to 500 mm which provides the present invention with a void of approximately the same dimension.

Figure 4:
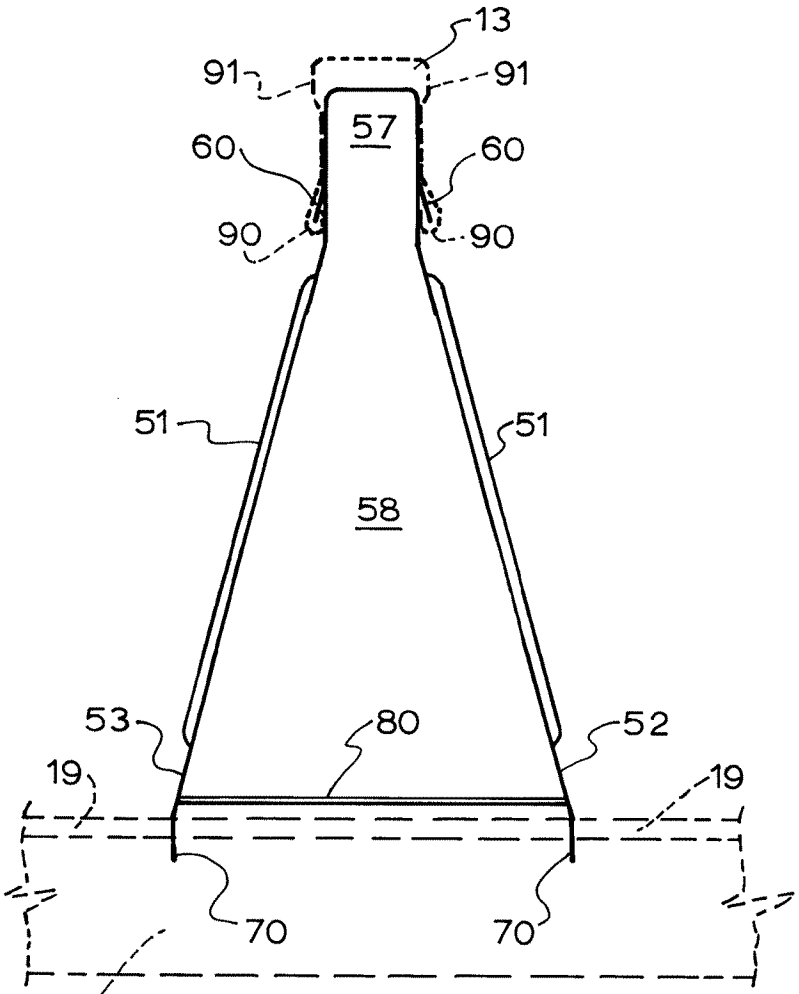
FIG. 4 shows one end view of the locking clip of FIG. 3.

In use as shown in FIG. 4 the clip 50 is inserted in an upward direction so that the ramp surfaces of the tabs 60 engage the laws 90 of the top cross rail 13. The resilient deformation of the flanges 52, 53 and the flanges 91 of the cross rail 13 provide for locating the clip 50 within the longitudinal slot formed between the flanges 91 of the cross rail 13. When the clip 50 and the projections 60 are moved past the longitudinal jaws 90, the clip 50 snap engages into the cross rail 13 between the flanges 91 and the jaws 90 engage with the bottom of the projections 60 and substantially retain the projections 60 within the jaws 90. The projections 60 then engage the portions 90 to inhibit removal of the clip 50 from within the top cross rail 13 by movement in a direction opposite the initial upward direction. As described above in relation to clip 20, the clip 50 can be removed from the top cross rail 13 by pushing the clip 50 in an upward direction and the longitudinal sides 91 of the top cross rail 13 being deformed to release the clip 50. Likewise to allow the correct positioning of the clip 20 within the top cross rail 13 the clip 20 is designed to be free to slide along the top cross rail 13 when the flanges 91 are resiliently deformed, therefore making the clip 20 adjustable within the top cross rail 13.

The hooks 70 engage with the out-turned opposing longitudinal jaws 19 extending from the furring channels 14 to secure the furring channel 14 in place. This then allows the plasterboard 15 to be secured by fasteners 16 to the bottom section of the furring channel 14. The plate 80 provides strengthening and ensures the hook end of the clip 50 is kept apart. An area or void 58 is formed in between the divergent flanges 52, 53. The void 58 can allow the routing of such items as air conditioning ducting or electrical wiring conduit through the clip 50.

FIG. 5 illustrates the use of both clips 20, 50 in a typical concealed suspended ceiling system showing flush mounted plasterboard 15 secured in place under the furring channels 14. As described above the complete structure is suspended from fixing points (not shown) on a roof or upon floor beams (or concrete floor) of a room of higher level by means of suspension hangers 12. The lower end of the hangar body plate is slotted to form inwardly directed hooks to attach the hangar 12 to the top cross rail 13. The top cross rail 13 has a longitudinal slot bordered by in-turned longitudinal extending jaws 90. A suitable form of furring channel 14 for the supporting of the plasterboard panels 15 is supported at right angles to the cross bars 13 by individual clip devices 20, 50. The plasterboard 15 is attached or screw fixed to the furring channel 14 by suitable fasteners 16. A plasterboard adhesive can be applied to the underside of the furring channel 14 before the plasterboard 15 is screw fixed in place. Plasterboard 15 or as it is also known as Gyprock is a lining material for walls and ceilings and consists of a gypsum plaster core that is encased in a heavy duty paper liner, which wraps around the long edges of the sheet.

Each clip device 20, 50 is formed as described above in relation to FIGS. 2 and 3. At an intermediate position the two arms have outwardly directed tabs 30, 60 for engaging with the longitudinal jaws 90. During assembly the clip device 20, 50 is forced upwardly into the slot of the top cross bar 13 with its base portion leading, so that the clip 20, 50 will be held by the tabs 30, 60 engaging with the longitudinal jaws 90 of the top cross bar 13. The outer edge of each downwardly extending arm 22, 23, 52, 53 of each clip 20, 50 are designed to carry two longitudinally extending hook elements 40, 70. The hook elements 40, 70 which are located at either end of the arms 22, 23, 52, 53 at spaced positions on the clip device 20, 50 and have their hooks 40, 70 confronting each other. The hook elements 40, 70 connect with the out-turned opposing longitudinal jaws 19 extending from the furring channels 14. The clips 20, 50 also comprise cut-out sections 42, 72 which allow the furring channel 14 to be inserted into the hook elements 40, 70 to be retained by the clips 20, 50.

FIG. 5 like FIGS. 6 and 7 described below provide a clear void between the furring channel 14 and the top cross rail 13 which provides the ability for the present invention to be utilised with many modern day items which are readily flush mounted or simply mounted in the ceiling.

FIG. 6 illustrates the use of the clip 50 in a concealed suspended ceiling system in which a speaker 110 and speaker grill 111 is flush mounted in the plasterboard panel 15 and substantially located within the void between the top cross rail 13 and the furring channel 14. Also shown in FIG. 6 is the easy routing of air conditioning ducting 100 behind the clip 50 and within the void between the top cross rail 13 and the furring channel 14. Likewise, if required the air-conditioning ducting may be routed through the void 58 in the clip 50 or in front of the clip 50. The distance referenced by Y is approximately 200 mm and is illustrated in FIG. 6 and clearly identifies the void and the improvement provided by the present invention. By way of example only the clip 50, flanges 52, 53 are approximately 200 mm in length which provides the clearance for the mounting of the speaker 110. It should be readily understood by the skilled addressee that the length of the flanges 52, 53 could range from 50 mm to 500 mm. Therefore providing a range of depths for the void formed in between the top cross rail 13 and the furring channel 14 and increasing the range of components which can be easily mounted within that void.

FIG. 7 illustrates a further use of the present invention in which the clip 50 in a concealed suspended ceiling system in which a light 120 with a light bulb or recessed light fitting 121 and mounting clip 123 are mounted in the plasterboard panel 15 and located within the void between the top cross rail 13 and the furring channel 14. When mounting components in the void between the top cross rail 13 and the bottom of the furring channel 14 it is often required to also route or mount auxiliary items such as electrical wiring conduits 122 and air conditioning ducting and registers in the void. These can be mounted behind the clips 50 as shown in FIG. 7 or can be routed through the void 58 within the clip 50 or in front of the clip 50. As would be appreciated a number of different items can be either mounted on the plasterboard 15 of a concealed ceiling or suspended from the plenum behind the plasterboard 15 of a suspended ceiling. For example, air conditioning plenum boxes and cushion boxes may be mounted in the void formed between the top cross rail 13 and the furring channel 14. These boxes typically are used to either supply air or return air in the air conditioning system and sit above the air conditioning registers within the ceiling space.

Figure 8:
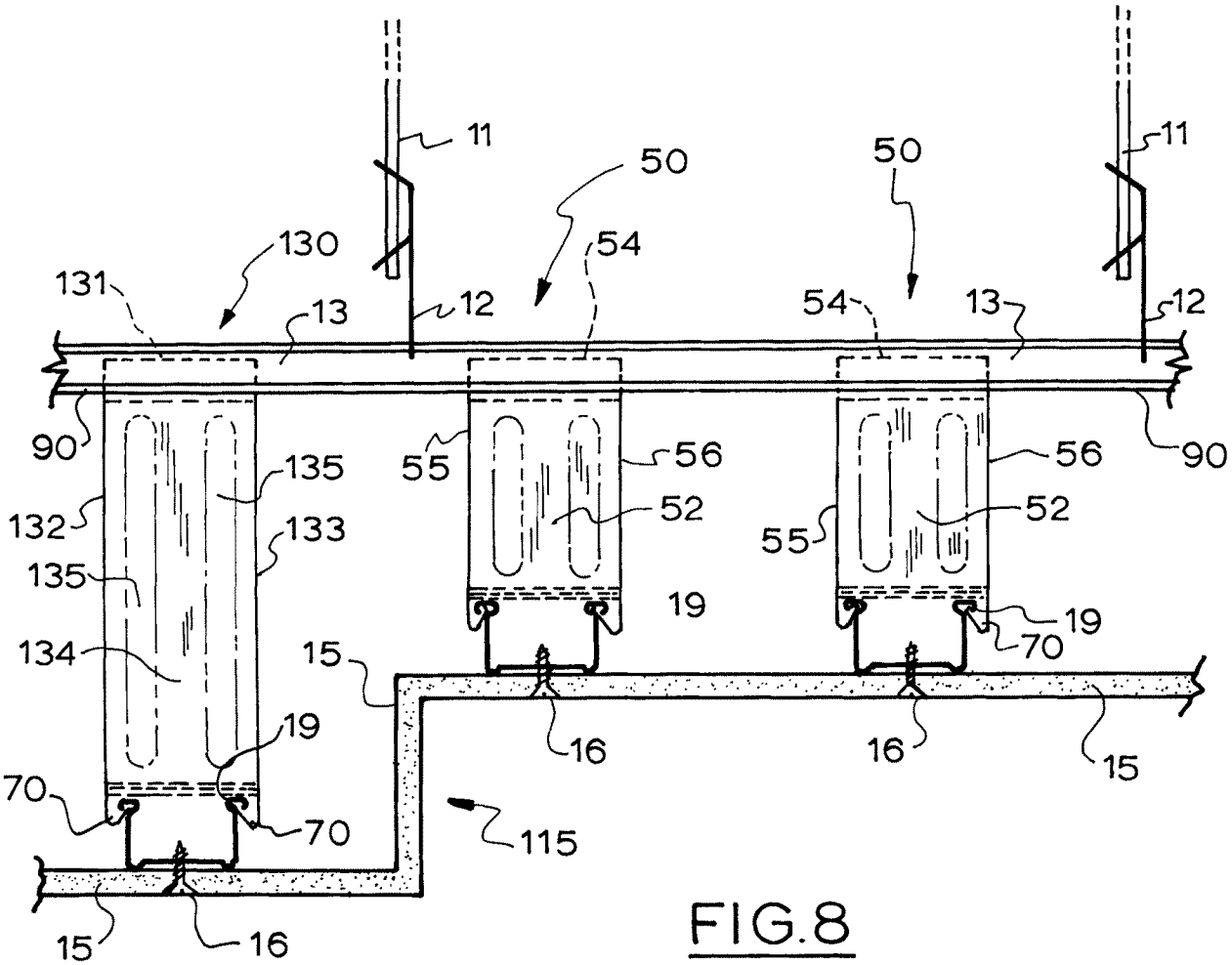
FIG. 8 illustrates a side view of a suspended ceiling showing the use of locking clips in accordance with an embodiment of the present invention for a bulkhead design for a ceiling.

FIG. 8 illustrates a further use of the present invention in which the clips 50, 130 in a concealed suspended ceiling system are used when a bulkhead or boxed section 115 is required. The term bulkhead is frequently used to denote any boxed in beam or other vertical wall extending down from a ceiling and by extension even the vertical face of an area of lower ceiling. Typically a bulkhead is used when an air-conditioning pipe, water and waste pipes or some other component which cannot be moved. In this case the suspended ceiling must be built around the exposed component. Bulkheads can also be used as ceiling features to show different heights in the ceiling.

By way of example only, and as illustrated in In FIG. 8, two clips 50 are utilised in a first section of the ceiling and a second clip 130 is utilised in a second section of the suspended ceiling. The first section having a horizontal plasterboard 15 mounted at a first height and the second section having a horizontal plasterboard 15 mounted at a second height. The two horizontal plasterboards 15 being joined by vertical plasterboard 15 to form the suspended ceiling. The clip 50 has a vertical length of approximately 200 mm and the clip 130 has a vertical length of approximately 400 mm. The difference in height of the two clips 50, 130 allows the formation of the suspended bulkhead 115.

The clip 130 like the clips 20 and 50 described above is designed to snap engage within the top cross rail 13. The clip 130 is of a channel configuration so as to have a longitudinal base 131 extending from a first end 132 to a second end 133 and a pair of longitudinally extending flanges 134 extending downwardly from the base 131. The flanges 134 have an initial intermediate section adjacent to the base 131 which extends at approximate right angle to and from the base 131 and houses the one or more projections or outwardly directed tabs. The flanges 134 forming an angle of approximately 30 degrees with a perpendicular axis passing through the centre of the base 131 and aligned with either end 132, 133.

Like the clips 20, 50 the projections are pressed from the flanges 134 in the intermediate section to form ramp surfaces. The clip 130 also has at least one and preferably two strengthening elements 135 in each flange 134. To provide further strengthening at the hook end of the clip 130 a plate is fixedly retained at bottom corners of the flanges 134 of the clip 130 Typically the plate is welded in place along the bottom edge adjacent the hooks 70 of each flange 134. Further plates may be inserted at different heights in between the flanges 134 and the location of each plate is dependent upon the length of the flanges 134 and subsequently the size of the void required between the back side of the plasterboard 15 and the bottom of the top cross rail 13.

The outer lower edge of each flange 134 carries two longitudinally extending hook elements 70 which are located at either end of the arms 134 at spaced positions on the clip device 130 and have their hooks 70 confronting each other. The hook elements 70 connect with the out-turned opposing longitudinal jaws 19 extending from the furring channels 14. The bottom section including the hooks 70 which project to an end point and a cut-out section which has been designed to allow the furring channel 14 to be inserted into the cut-out section. The opposing longitudinal jaws 19 of the furring channel 14 are forced upwardly into and retained within the hooks 70 of the clip 130. Thus the shape of the cut-out section substantially conforms to the shape of the top section of the furring channel 14. Each arm or flange 134 is sized so as to provide the clearance between the top cross rail 13 and the bottom of the furring channel 14 to which surface the plasterboard 15 is fixed. Therefore providing a void in between the back side of the plasterboard 15 and the bottom of the top cross rail 13 allowing such items as speakers, and lights and air-conditioning components to be easily installed.

As would be appreciated the clips and the suspended ceiling components can be manufactured from any resiliently deformable material. That is a material which has the ability to absorb energy when it is deformed elastically, and release that energy upon unloading. For example any material which when subjected to a stress causes a change of dimensions in the material and upon release of the stress returns to substantially the same dimensions, such as sheet metal made from aluminium or steel. Another sheet product which is becoming popular for its lightweight and high strength to density ratio characteristics is high-density polyethylene (HDPE) or polyethylene high-density (PEHD) which is a polyethylene thermoplastic made from petroleum. The present invention can also be manufactured from HDPE or other plastic material which is capable of being resiliently deformed.

While the above shapes have been described in use, it should be understood that other shapes and sizes can be used without departing from the present invention. The size of the clip 20, 50, 130 may range from having flanges with a height ranging from 50 mm to 500 mm.

Likewise while a few applications have been described the present invention is not limited to only those applications. For example the present invention could also be used to produce a curved or raked ceiling or any cantilevered ceiling.

While the present invention has been described to provide a void for flush mounted or ceiling mounted components such as lights, air-conditioning modules and speakers, it should be appreciated that a number of different components could be flush mounted or mounted within the ceiling which required a void behind the plasterboard in order to be able to be correctly mounted. Therefor the present invention should not be limited to only those items described.

The positioning of and number of suspension hangers, top cross rails, furring channels and clips is dependent upon the particular concealed suspended ceiling required and will typically be decided upon when the ceiling load is determined during the design process.

While the above suspended ceilings have typically been described regarding internal ceilings constructed within a building it should also be appreciated that the suspended ceiling could be fitted externally to a building. For example a suspended ceiling under an outdoor awning.

ADVANTAGES

The present invention provides the advantage of a gap between the top cross channel and the rear side of the plasterboard which allows items to be easily and reliably mounted in the suspended plasterboard ceiling. In order for these direct-fix systems to be more aesthetically pleasing, they typically require special supporting grids in order to suspend the plasterboard. With plasterboard being directly fixed to a furring channel the distance between the finished plasterboard surface and the top cross rail is determined by the locking key which retains the furring channel to the top cross rail. By providing a locking key or clip with the extended side flanges provides the versatility to easily mount recessed lighting or the like components in the ceiling.

Given the number of furring channels and top cross rails required to direct fix the plasterboard, it can be somewhat limiting where items like lighting, speakers and air conditioning ducts and vents can be placed. These items are typically flush mounted onto the outside surface of the plasterboard and the majority of the size of these items is located within the ceiling cavity formed between the plasterboard and the grid work of channels forming the suspended ceiling frame. Therefore providing a clip with sufficient clearance within the cavity allows the mounting of most items to the ceiling. Likewise these items are normally mounted using some form of clip retainer which needs to be located on the opposite side of the plasterboard to where the item is located, so there must also be sufficient clearance for these attachment devices within the grid work of channels of the suspended ceiling. The present invention provides that clearance and ability to mount such items easily in the suspended ceiling.

VARIATIONS

It will be realized that the foregoing has been given by way of illustrative example only and that all other modifications and variations as would be apparent to persons skilled in the art are deemed to fall within the broad scope and ambit of the invention as herein set forth.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

The invention claimed is:

1. A suspended ceiling within a room of a building or an external ceiling, comprising when assembled within said room:

a plurality of parallel spaced top cross rails;

a plurality of adjustable length hanger assemblies anchored to structural parts of the building and connected with each top cross rail suspending same at a selected height in a common plane with other ones of said top cross rails;

a first clip for joining the top cross rails to a first group of parallel mounted furring channels such that the first group of parallel mounted furring channels are spaced apart a first pre-determined distance from the top cross rails to provide a void therebetween;

wherein, the first clip comprises a longitudinally extending base;

a pair of flanges extending downwardly from the base and between which the base is located;

a pair of hooks on each flange, each pair of hooks adapted to releasably connect to the first group of parallel mounted furring channels;

at least one projection in each flange, each projection adapted to engage with a surface on the top cross rails; and wherein the pair of flanges are resiliently deformed to allow insertion of the first clip within the top cross rail and each flange extends a pre-determined distance from the base so as to space apart the top cross rail and the first group of parallel mounted furring channels when the first clip is secured within a longitudinal slot of the top cross rails and connected to the first group of parallel mounted furring channels, thereby providing a void therebetween, wherein the void between the top cross rails and the first group of parallel mounted furring channels provided by the first clip is sized to allow clearance for mounting of components in a first void formed between i) a first flush mounted builders ceiling board fixed to a bottom of the first group of parallel mounted furring channels and ii) a bottom of the top cross rail;

a second clip for joining the top cross rails to a second group of parallel mounted furring channels such that the second group of parallel mounted furring channels are spaced apart a second pre-determined distance from the top cross rails to provide a void therebetween;

wherein the second clip comprises a longitudinally extending base;

a pair of flanges extending downwardly from the base and between which the base is located;

a pair of hooks on each flange, each pair of hooks adapted to releasably connect to the second group of parallel mounted furring channels;

at least one projection in each flange, each projection adapted to engage with a surface on the top cross rails; and wherein the pair of flanges are resiliently deformed to allow insertion of the clip within the top cross rails and each flange extends a pre-determined distance from the base so as to space apart the top cross rails and the parallel mounted furring channels when the clip is secured within a longitudinal slot of the top cross rails and connected to the second group of parallel mounted furring channels, thereby providing a void therebetween, wherein the void between the top cross rails and the second group of parallel mounted furring channels provided by the second clip is sized to allow clearance for mounting of components in a second void formed between i) a second flush mounted builders ceiling board fixed to a bottom of the second group of parallel mounted furring channels and ii) a bottom of the top cross rails;

the first flush mounted builders ceiling board fixed to the first group of parallel mounted furring channels;

the second flush mounted builders ceiling board fixed to the second group of parallel mounted furring channels;

a vertically mounted third flush mounted builders ceiling board to close a gap between the first flush mounted builders ceiling board and the second flush mounted builders ceiling board; and wherein the second pre-determined distance is greater than the first pre-determined distance to therefore form two different heights in the ceiling.

2. A suspended ceiling as claimed in claim 1, wherein the first and second clips are used to design a bulkhead in the suspended ceiling.

* * * * *